US011530849B2

(12) United States Patent
Spath

(10) Patent No.: US 11,530,849 B2
(45) Date of Patent: Dec. 20, 2022

(54) RESPONSIVE COOLING BASED ON EXTERNAL FACTORS

(71) Applicant: Carrier Corporation, Palm Beach Gardens, FL (US)

(72) Inventor: Tony Spath, West Hartford, CT (US)

(73) Assignee: CARRIER CORPORATION, Palm Beach Gardens, FL (US)

( * ) Notice: Subject to any disclaimer, the term of this patent is extended or adjusted under 35 U.S.C. 154(b) by 257 days.

(21) Appl. No.: 16/753,659

(22) PCT Filed: Oct. 5, 2018

(86) PCT No.: PCT/US2018/054585

§ 371 (c)(1),
(2) Date: Apr. 3, 2020

(87) PCT Pub. No.: WO2019/071112

PCT Pub. Date: Apr. 11, 2019

(65) Prior Publication Data

US 2020/0256593 A1 Aug. 13, 2020

Related U.S. Application Data

(60) Provisional application No. 62/569,287, filed on Oct. 6, 2017.

(51) Int. Cl.
*F25B 21/02* (2006.01)
*F25D 11/00* (2006.01)
(Continued)

(52) U.S. Cl.
CPC ..... *F25B 21/02* (2013.01); *F25D 11/003* (2013.01); *F25D 19/00* (2013.01); *F25D 23/00* (2013.01);
(Continued)

(58) Field of Classification Search
CPC ..... F25B 21/02; F25D 21/00; F25D 23/00
See application file for complete search history.

(56) References Cited

U.S. PATENT DOCUMENTS 5,256,907 A * 10/1993 Shimada ..... H02J 3/30 318/161
5,301,508 A 4/1994 Kahl et al.
(Continued)

FOREIGN PATENT DOCUMENTS

CN 102667379 A 9/2012
CN 104135403 A 11/2014
(Continued)

OTHER PUBLICATIONS

Translation of JP2009192151 entitled JP2009192151A (Year:2009).*
(Continued)

*Primary Examiner* — Len Tran
*Assistant Examiner* — Dae Hyun Jin
(74) *Attorney, Agent, or Firm* — Cantor Colburn LLP

(57) ABSTRACT

An environmental control unit for use with a transport container is disclosed. The environmental control unit includes a thermoelectric device, a fan configured to blow air across the thermoelectric device, a cooling module, a controller in electronic communication with the thermoelectric device and the fan, and a communication module in electronic communication with the controller. The communication module is configured to transmit parameters of the environmental control unit to a computing device through wireless communication. The controller is also configured to determine a present location of the transport container, determine a destination of the transport container, evaluate an internal temperature of the transport container, and control an on or off condition of the thermoelectric device based
(Continued)

on the present location, the destination, and the internal temperature of the transport container.

20 Claims, 5 Drawing Sheets

(51) Int. Cl.
*F25D 19/00* (2006.01)
*F25D 23/00* (2006.01)
*F25D 29/00* (2006.01)

(52) U.S. Cl.
CPC ..... *F25D 29/003* (2013.01); *F25B 2321/023* (2013.01); *F25D 2700/121* (2013.01)

(56) References Cited

U.S. PATENT DOCUMENTS

| | | | | |
|---|---|---|---|---|
| 5,457,963 | A | 10/1995 | Cahill-O'Brien et al. | |
| 5,572,873 | A | 11/1996 | Lavigne et al. | |
| 6,354,104 | B1 * | 3/2002 | Feagin | A61B 10/0096 70/68 |
| 6,378,319 | B1 | 4/2002 | Mani | |
| 6,668,240 | B2 | 12/2003 | Singh et al. | |
| 6,712,276 | B1 | 3/2004 | Abali et al. | |
| 6,944,574 | B2 | 9/2005 | Leblanc et al. | |
| 7,046,148 | B2 | 5/2006 | Miyazawa | |
| 7,174,277 | B2 | 2/2007 | Vock et al. | |
| 7,339,469 | B2 | 3/2008 | Braun | |
| 7,392,150 | B2 | 6/2008 | Kuepper et al. | |
| 7,454,315 | B2 | 11/2008 | Kadaba | |
| 7,455,225 | B1 | 11/2008 | Hadfield et al. | |
| 8,154,421 | B2 | 4/2012 | Saltzman et al. | |
| 8,893,032 | B2 | 11/2014 | Bruck et al. | |
| 8,967,457 | B2 | 3/2015 | Shin et al. | |
| 9,087,333 | B2 | 7/2015 | Kim et al. | |
| 9,339,045 | B2 | 5/2016 | Chadwick et al. | |
| 9,492,035 | B2 | 11/2016 | Pavel et al. | |
| 9,712,893 | B2 | 7/2017 | Warkentin et al. | |
| 2010/0264048 | A1 | 10/2010 | Gunsberg | |
| 2011/0193710 | A1 | 8/2011 | McIlvain et al. | |
| 2013/0082044 | A1 | 4/2013 | Doan | |
| 2014/0150464 | A1 | 6/2014 | Bloedow et al. | |
| 2014/0180953 | A1 | 6/2014 | Westcott et al. | |
| 2016/0209111 | A1 * | 7/2016 | Jafa | F25D 31/007 |
| 2016/0292634 | A1 | 10/2016 | Mehring et al. | |
| 2016/0379179 | A1 | 12/2016 | Roisen et al. | |
| 2017/0108253 | A1 | 4/2017 | Monroy | |
| 2017/0206497 | A1 | 7/2017 | Kriss | |
| 2019/0003757 | A1 * | 1/2019 | Miros | F25D 29/003 |

FOREIGN PATENT DOCUMENTS

| | | | |
|---|---|---|---|
| CN | 106715182 | A | 5/2017 |
| EP | 1580145 | A1 | 9/2005 |
| EP | 2588343 | A2 | 5/2013 |
| JP | 2009192151 | A * | 8/2009 |
| WO | 0125701 | A1 | 4/2001 |
| WO | 2016181223 | A1 | 11/2016 |
| WO | 2017017504 | A1 | 2/2017 |
| WO | 2017096171 | A1 | 6/2017 |

OTHER PUBLICATIONS

International Search Report and Written Opinon for application PCT/US208/054585 , dated Dec. 21, 2018, 14 pages.

European Office Action; European Application No. 18795870.7; dated Feb. 24, 2022; 8 pages.

* cited by examiner

RESPONSIVE COOLING BASED ON EXTERNAL FACTORS

BACKGROUND

The subject matter disclosed herein generally relates to the field of transport containers, and more particularly to an apparatus and method for cooling transport containers.

Refrigerated trucks and trailers are commonly used to transport perishable cargo, such as, for example, produce, meat, poultry, fish, dairy products, cut flowers, and other fresh or frozen perishable products. A transport refrigeration system is mounted to the truck or to the trailer in operative association with a cargo space defined within the truck or trailer for maintaining a controlled temperature environment within the cargo space.

Conventionally, transport refrigeration systems used in connection with refrigerated trucks and refrigerated trailers include a transport environmental control unit having a refrigerant compressor, a condenser with one or more associated condenser fans, an expansion device, and an evaporator with one or more associated evaporator fans, which are connected via appropriate refrigerant lines in a closed refrigerant flow circuit. Air or an air/gas mixture is drawn from the interior volume of the cargo space by means of the evaporator fan(s) associated with the evaporator, passed through the airside of the evaporator in heat exchange relationship with refrigerant whereby the refrigerant absorbs heat from the air, thereby cooling the air. The cooled air is then supplied back to the cargo space.

Currently last mile cooling is served by either dry ice or just insulated containers, there are few use cases where a smaller compressor driven system can be used due to size, weight, etc. Typically, the perishable cargo within the truck's transport refrigeration system is contained within simple cardboard boxes, wooden crates, or plastic containers and is cooled or heated by the truck's environmental control system. Upon arriving at a destination the perishable cargo is unloaded onto a dock or other uncontrolled area where it may sit for hours until it could be moved to an environmentally controlled location. The perishable cargo may also need to be transported for the "last mile" to the consumer via a non-refrigerated means, such as a motorcycle or truck. This time spent on dock or in "last mile" transit, out of a controlled environment, leads to the degradation of the product life and ultimately leads to a lower quality product being served to the end consumer.

BRIEF DESCRIPTION

Disclosed is an environmental control unit for use with a transport container. The environmental control unit includes a thermoelectric device, a fan configured to blow air across the thermoelectric device, a cooling module configured to receive the air blown across the thermoelectric device and convey the air to a compartment of a transport container when the transport container is removably connected to the environmental control unit, a controller in electronic communication with the thermoelectric device and the fan, and a communication module in electronic communication with the controller. The communication module is configured to transmit parameters of the environmental control unit to a computing device through wireless communication. The controller is configured to determine a present location of the transport container, determine a destination of the transport container, evaluate an internal temperature of the transport container, and control an on or off condition of the thermoelectric device based on the present location, the destination, and the internal temperature of the transport container.

Also disclosed is a refrigerated transport system that includes a transport container, and an environmental control unit removably connected to the transport container. The environmental control unit includes a thermoelectric device, a fan configured to blow air across the thermoelectric device, a cooling module configured to receive the air blown across the thermoelectric device and convey the air to a compartment of the transport container, a controller in electronic communication with the thermoelectric device and the fan, and a communication module in electronic communication with the controller and wireless communication with a computing device. The communication module is configured to transmit parameters of the environmental control unit to the computing device through wireless communication. The controller is configured to determine a present location of the transport container, determine a destination of the transport container, evaluate an internal temperature of the transport container, and control an on or off condition of the thermoelectric device based on the present location, the destination, and the internal temperature of the transport container.

Also disclosed is a method of managing environmental conditions within a refrigerated transport system through a computing device. The method includes determining, via a processor in the computing device, a present location of the refrigerated transport system, and determining, via the processor, a destination of the refrigerated transport system. The method further includes evaluating, via the processor, an internal temperature of the refrigerated transport system, and controlling, via the processor, an on or off condition of a thermoelectric device based on the present location, the destination, and the internal temperature of the refrigerated transport system.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Various embodiments of the present disclosure are related to environmental control of perishable cargo during the "last mile" of delivery. Typically, the perishable cargo in a truck's transport environmental control system is contained within simple cardboard boxes, wooden crates, or plastic containers. The perishable cargo may need to be transported on smaller-vehicles without environmental control systems over the "last-mile" to make it to market. The term "last mile" is figurative to illustrate the final stretch of a supply chain that perishable goods may take to arrive at a market. Often large trucks with environmental control systems cannot carry the perishable goods through this "last mile" due to multiple reasons, such as, for example, the size of city streets. For these reasons, smaller vehicles must carry the perishable goods over the "last mile", such as for example, motorcycles, mopeds, bicycles, and rickshaws. This time spent on smaller vehicles, out of a controlled environment leads to degradation of the product life and ultimately leads to a lower quality product being available to the end consumer. For instance, the life of a fragile ripe at harvest fruit such as, for example, raspberries and blueberries, decreases with the amount of time they spend in ambient air. Advantageously, the embodiments disclosed herein help preserve perishable goods through the "last mile" of the supply chain by automatic control of the cooling function based on external factors to the cooling system including location, destination, starting position, relative humidity, and the product being cooled.

Figure 1:
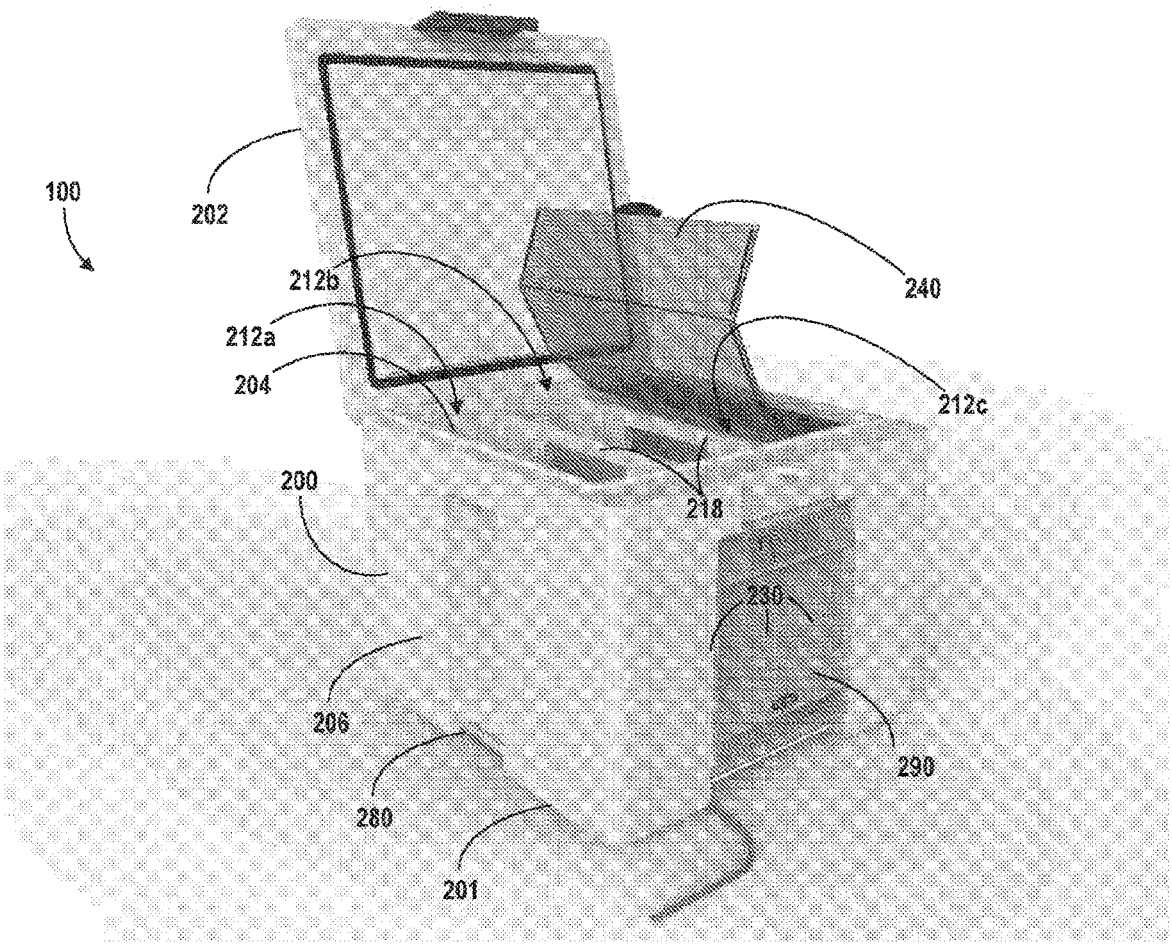
FIG. 1 illustrates a isometric view of a refrigerated transport system, in accordance with an embodiment of the disclosure.

Referring to FIG. 1, which depicts an isometric view of a refrigerated transport system 100 in an example embodiment. The refrigerated transport system 100 includes a transport container 200 and an environmental control unit 290 removably connected to the transport container 200. The environmental control unit 290 may be removable from the transport container 200 and may be connected to a variety of different transport containers other than what is depicted in the illustrated embodiment of FIG. 1. The environmental control unit 290 provides cooling to the transport container through one or more cooling modules 362 (depicted in FIG. 2) and will be discussed further below. In order to removably connect the environmental control unit 290 to the transport container 200, one or more orifices 230 are formed in the base 201 of the transport container 200 and then cooling modules 362 inserted into each orifice 230. There may be one cooling module 362 for each compartment 212 of the transport container 200, thus there may be one orifice 230 for each compartment 212. The cooling modules 362 may include seals (not shown) configured to seal the connection between each formed orifices 230 and each cooling modules 362.

The transport container 200 may be composed of a base 201 and a lid 202. As shown in FIG. 1, base 201 may be an open ended container wherein perishable cargo, such as, for example, produce, meat, poultry, fish, dairy products, cut flowers, pharmaceuticals, organs, and other fresh/frozen perishable products, is stowed for transport. The lid 202 is configured to fit on the base 201, thus enclosing the perishable cargo within the transport container 200. The lid 202 is configured to securely fasten to the base 201 such that an airtight seal is created between the lid 202 and the base 201. In various embodiments, the base 201 and the lid 202 may be composed of a plastic, metal vacuum, extruded polystyrene foam, polyurethane foam, polyethylene foam, or other lightweight insulating material. In one embodiment, the base 201 is collapsible and may be folded when not in use for easy storage and transportation.

The base 201 further includes an interior 204 and an exterior 206. The interior 204 houses the perishable goods and may be subdivided into one or more separate compartments 212*a*-212*c* by one or more dividers 218. A secondary lid 240 may provide additional insulation to each of the compartments 212*a*-212*c* and/or the interior 204 in general. The secondary lid 240 also keeps additional cold air from escaping, thus increasing efficiency. In an embodiment, the secondary lid 240 may be transparent, which advantageously provides the opportunity to still see goods in each compartment 212*a*-212*c*. One or more anchors 280 may be configured on the exterior 206 of the base 201 so that the refrigerated transport system 100 may be secured to a vehicle, such as, for example a motorcycle.

Figure 2:
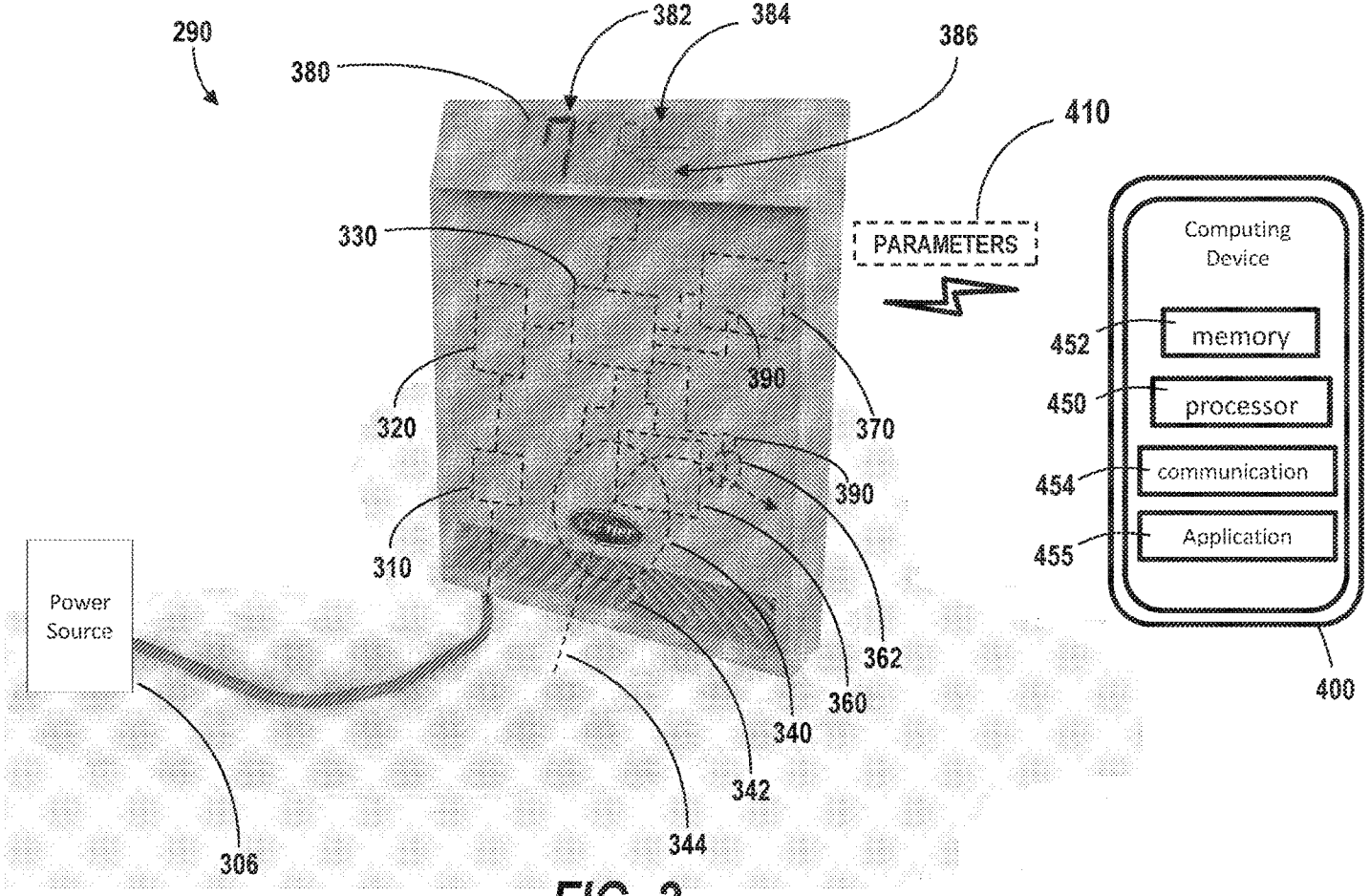
FIG. 2 illustrates an isometric view of an environmental control unit, in accordance with an embodiment of the disclosure.

Referring now to FIG. 2 with continued reference to FIG. 1. FIG. 2 illustrates an isometric view of the environmental control unit 290. The environmental control unit 290 may include a power convertor 310, a battery 320, a controller 330, a fan 340, a thermoelectric device 360, a communication module 370, and a control panel 380. The thermoelectric device 360 provides cooling to the transport container 200. The thermoelectric device 360 in operation generates heating/cooling by creating a temperature difference across two sides of the thermoelectric device 360 when a voltage is applied to the thermoelectric device 360. The amount of heating and cooling changes in response to polarity of the voltage that is applied to the thermoelectric device 360 as the material properties cause the atoms to diffuse to a first side or a second side of the thermoelectric device 360. This is also known as Peltier effect. In an embodiment, there is a thermoelectric device 360 for each compartment 212. There may be a single fan 340 or a fan 340 for each thermoelectric device 360. The fan 340 pulls in air 344 external to environmental control unit 290 through a vent 342. The air 344 that passes across the thermoelectric device 360 is cooled and is then sent through the cooling modules 362 into the transport container 200. It is to be understood that the term "air" when used herein with reference to the atmosphere draw into the environmental control unit 290 by the fan 340 may include a mixture of oxygen with other gases, such as for example, but not limited to, nitrogen or carbon dioxide. The fan 340 may be rotated by a fan motor (not shown) powered by the power source 306 and/or the battery 320.

The environmental control unit 290 also includes a controller 330 configured for controlling the operation of the environmental control unit 290 including, but not limited to, the operation of thermoelectric device 360 and fan 340 to provide and maintain a desired thermal environment within the transport container 200. The controller 330 may be an electronic controller including a processor and an associated memory comprising computer-executable instructions that, when executed by the processor, cause the processor to perform various operations. The processor may be but is not limited to a single-processor or multi-processor system of any of a wide array of possible architectures, including field programmable gate array (FPGA), central processing unit (CPU), application specific integrated circuits (ASIC), digital signal processor (DSP) or graphics processing unit (GPU) hardware arranged homogenously or heterogeneously. The memory may be a storage device such as, for example, a random access memory (RAM), read only memory (ROM), or other electronic, optical, magnetic or any other computer readable medium. The operation of the environmental control unit 290 may also be controlled through the control panel 380 located on the exterior of the environmental control unit 290. Using the control panel 380, users may set a selected temperature 382 for each compartment 212 of the refrigerated transport system 100. Also using the control panel 380, users may set a maximum temperature 386 and a minimum temperature 384 for the selected temperature 382.

The controller 330 is in electronic communication with the communication module 370. The communication module 370 may be in wireless communication with a computing device 400, such as, for example a smart phone, PDA, smart watch, tablet, laptop computer, desktop computer etc. The computing device 400 may include a touch screen (not shown), mouse, keyboard, scroll wheel, physical button, or any input mechanism known to one of skill in the art. The computing device 400 may include a processor 450, memory 452 and communication module 454 as shown in FIG. 2. The processor 450 can be any type or combination of computer processors, such as a microprocessor, microcontroller, digital signal processor, application specific integrated circuit, programmable logic device, and/or field programmable gate array. The memory 452 is an example of a non-transitory computer readable storage medium tangibly embodied in the computing device 400 including executable instructions stored therein, for instance, as firmware. The communication module 454 may implement one or more communication protocols as described in further detail herein. Embodiments herein generate a graphical user interface on the computing device 400 through an application 455. One exemplary graphic user interface 460 is shown with respect to FIG. 3. The computing device 400 may view and/or adjust parameters 410 of the environmental control system through the application 455.

The wireless communication between the communication module 370 of the environmental control units 290 and the communication module 454 of the computing device 400 may be satellite, WiFi, cellular, Bluetooth, radio communication or any other wireless communication method known to one of skill in the art. The computing device 400 may be configured to wirelessly control the operation of the environmental control unit 290 and/or display the parameters 410 of the environmental control unit 290. The parameters 410 may include but are not limited to location of the environmental control unit 290, temperature of the cooling output of the environmental control unit 290, and humidity of the cooling output of the environmental control unit 290. The location and temperature output may be detected but one or more sensors 390. In an embodiment, a sensor 390 may include a temperature sensor or humidity sensor. The temperature sensor or humidity sensor may be located proximate the one or more cooling modules 362. In an embodiment, a sensor 390 may include a GPS sensor configured to determine the location of the environmental control unit 290. In another embodiment, a destination may be included as one of the parameters 410, where the destination is the physical destination intended for one or more of the items being cooled by the transport container 200. In another aspect, the parameters include a number of times the lid 202 and/or 240 have been opened.

In another aspect, the parameters may include a relative position of the items being cooled within the transport container 200. For example, one or more piezoelectric or other configured sensor may determine a position of an item relative to one or more positions of other items within the transport container 200. In one embodiment, the relative position of the items may be included in a determination of the operation of the environmental control unit 290.

The environmental control unit 290 may be powered by a power source 306 and/or a battery 320. The power source 306 may charge the battery 320 such that the battery 320 may provide power to the environmental control unit 290 when the environmental control unit 290 is receiving reduced and/or no power from the power source 306. The power source 306 may comprise an AC generator configured to generate alternating current (AC) power including at least one AC voltage at one or more frequencies. In an embodiment, the power source 306 may, for example, be a permanent magnet AC generator or a synchronous AC generator. In another embodiment, the power source 306 may comprise a single onboard, DC generator configured to generate direct current (DC) power at least one voltage. In an embodiment, the power source 306 is a fly wheel generator operably connected to a rotating component of a vehicle. In an embodiment, the power source 306 may be an onboard battery of a vehicle, such as, for example a 12 Volt battery. Some power sources may have internal voltage regulators while other power sources do not. It is to be understood that various power converters 310, such as AC to DC rectifiers, DC to AC inverters, AC to AC voltage/frequency converters, and DC to DC voltage converters, may be employed in connection with the power source 306 as appropriate. The power converter 310 may include a voltage sensor to sense the voltage of the power source 306. The power source 306 may also include a battery, a solar panel, or any similar power source known to one of skill in the art.

Figure 3:
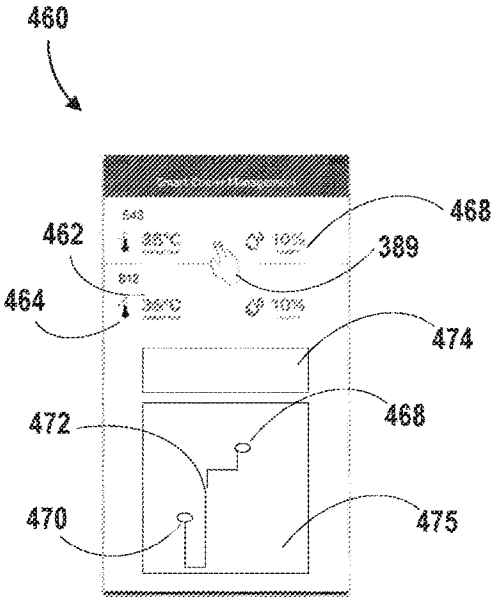
FIG. 3 illustrates a view of an exemplary graphic user interface in accordance with an embodiment of the disclosure.

FIG. 3 depicts the exemplary user interface 460 in accordance with an embodiment. In some aspects, the graphic user interface 460 can include the one or more parameters 420 such as, for example, a temperature 462, a graphical representation of the temperature 464, a humidity of the current environment, etc. In some aspects one or more fields are user-selectable 389 to show other additional parameters. In one aspect, each of the parameters 420 may be user-selectable to toggle on/off, which may control whether that particular parameter is included in the automated control of the environmental control unit 290. The graphic user interface 460 can also include a map interface 475 that indicates a current position along a route 472, a starting position 468, and an intended destination 470. The route 472 is user selectable based on a particular mode of transportation used with the device (e.g., motorcycle vs. automobile).

Figure 4:
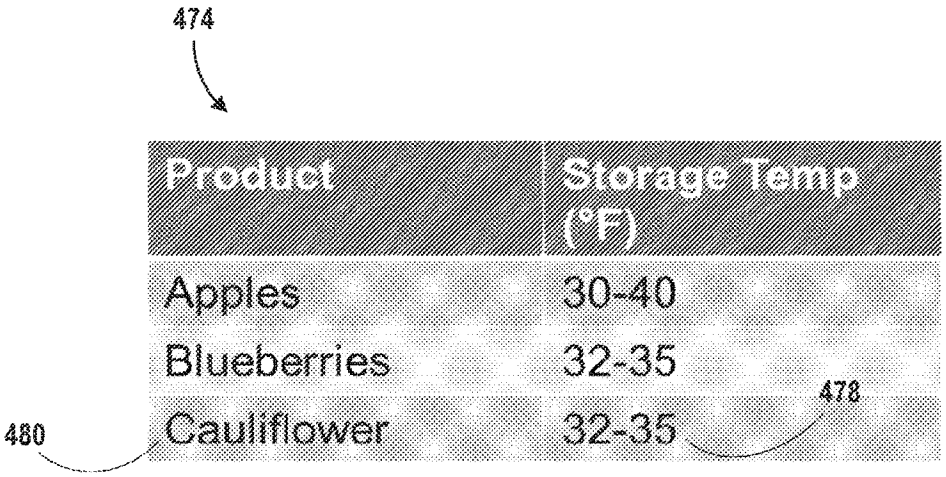
FIG. 4 illustrates another exemplary graphic user interface in accordance with an embodiment of the disclosure.

In one aspect, the graphic user interface 460 includes a product temperature matrix 474, which shows an allowable temperature range 478 for products stored (or that may be stored) in the transport container 200. FIG. 4 depicts an exemplary screen graphic showing one or more user-selectable product fields 480. In one aspect, the processor may receive one or more user selections indicative of one or more products stored in the transport container 200.

According to one embodiment, the processor 450 may determine a starting position 468 and an intended destination 470 for one or more of the stored products indicated as being transported in the product temperature matrix 474. The processor 450 may also determine an intended or suggested route 472. In one embodiment, the processor 450 may determine, based on one or more of the parameters 420 whether the suggested storage temperature for each of the stored products stored in the transport container 200 will exceed its ideal storage temperature range. Exceeding an ideal storage temperature range may include, for example, obtaining an amount of heat that raises the internal temperature in the transport container 200 outside of (higher than) the ideal or safe storage temperature range 478 for a particular product indicated as being stored in the transport container 200. In one aspect, responsive to determining that the internal temperature is or is predicted to exceed the storage temperature range 478, the processor 450 can alter the route 472 and indicate the new route in the map 475.

Figure 5:
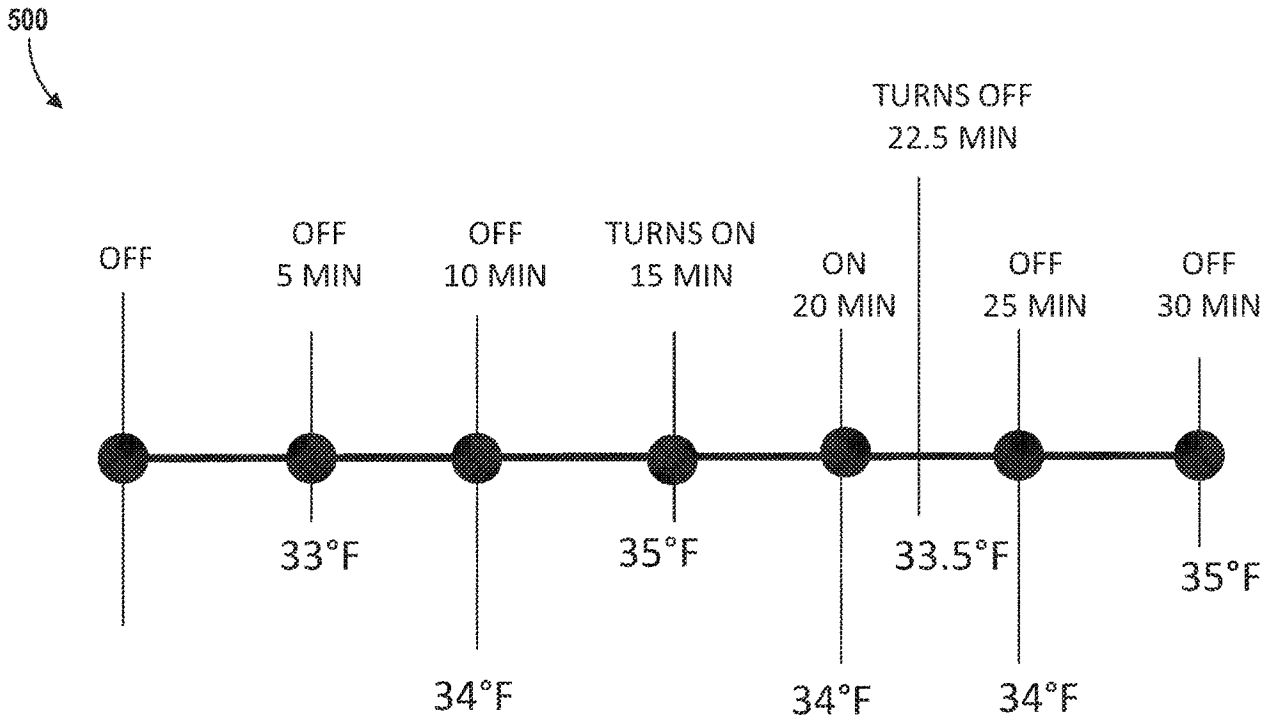
FIG. 5 illustrates an exemplary implementation of the refrigerated transport system of FIG. 1, according to an embodiment of the disclosure.

According to another embodiment, the processor 450 may determine a power level remaining in the power source 306, determine an internal temperature of the transport container 200, and control an on or off condition of the cooling modules 362. For example, as shown in FIG. 5, the processor 450 may determine, based on one or more of the destination, the current position, the ambient air temperature, the internal air temperature, whether there is sufficient condition inside of the transport container 200 to maintain the ideal temperature(s) for the items transported with the cooling modules 362 switched off some or all of the time on the remaining portion of the intended route. For example, referring to FIG. 5, the processor 450 may determine, based on the parameters 420, that the cooling modules 362 should be switched from a currently "off" position to an on position until the internal temperature reaches 33 degrees F. The processor 450 may switch the cooling modules 362 off for a ten minute interval at an internal temperature reading of 34 degrees F. After fifteen minutes, at an internal reading of 35 degrees F., the processor 450 may turn the cooling elements on for a twenty minute interval, to bring the temperature to 34 degrees F., etc. In some aspects, the processor 450 determines the on and off conditions of the cooling modules based on a combination of the current location, the intended destination, the ambient (outside) temperature, and the internal temperature of the transport container 200. The operation of the environmental control unit is also selectably adjustable by the processor 450 based on other parameters, including traffic conditions, waypoints during a delivery schedule, anticipated lid opening(s), and other factors.

Figure 6:
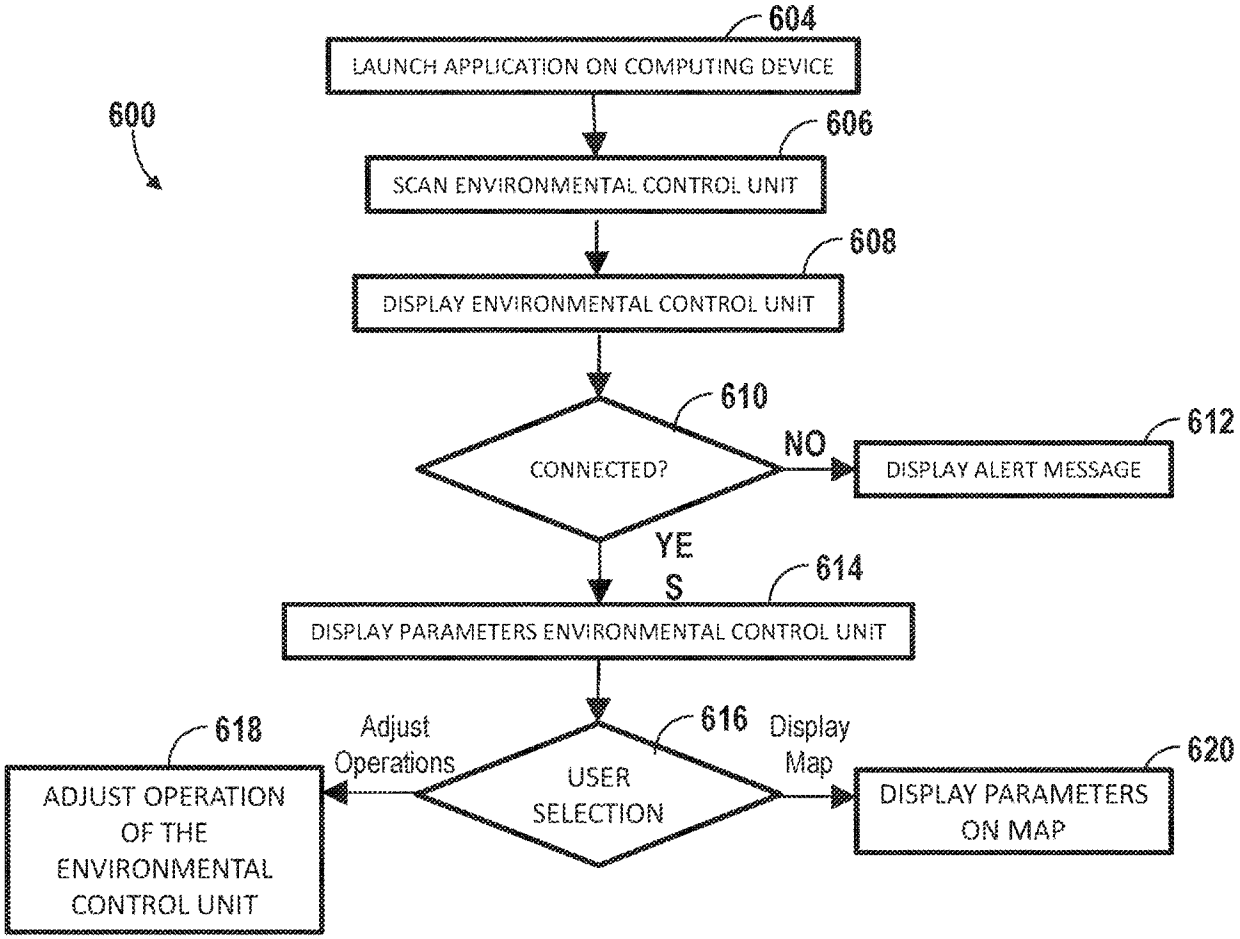
FIG. 6 is a flow diagram illustrating management of environmental conditions within a refrigerated transport system, according to an embodiment of the present disclosure.

Referring now to FIG. 6, while referencing components of FIG. 1. FIG. 6 shows a flow diagram illustrating a method 600 of managing environmental conditions within a refrigerated transport system 100 through a computing device, such as the computing device 400. As a preliminary step, a first action includes removably connecting an environmental control unit 290 to a transport container 200 if not already connected. One or more orifices 230 may be formed in the base 201 of the transport container 200 to removably connect the environmental control unit 290 to the transport container 200. A cooling module 362 may be configured to slide into each of the formed orifices 230. As mentioned above, there may be one cooling module 362 for each compartment 212, thus there may be one orifice 230 for each compartment 212. The cooling modules 362 can include seals (not shown) configured to seal the connection between each formed orifice 230 and each cooling module 362. At block 604, the processor 450 instantiates an application in the graphic user interface 460 of the computing device 400.

At bock 606, the computing device 400, using the instantiated application of block 604, scans for environmental control units 290 located within a user-selectable radius of the computing device 400. A selected radius may be, for example, one meter. In another aspect, a user-selectable radius may be one kilometer. It should be appreciated that any theoretical radial distance is contemplated. Responsive to detecting one or more environmental control units 290 within the selected radius, at block 608, the computing device 400 displays, through the graphic user interface 460, the one or more environmental control units 290 located within a selected radius of the computing device 400. A user may selected a environmental control unit 290 through the graphic user interface 460 in order to connect with the environmental control unit 290.

At block 610, will confirm when the computing device 400 is connected to the particular environmental control unit 290. If the computing device 400 does not connect to the environmental control unit 290 then an alert message may display on the computing device 400 through the graphic user interface 460 at block 612. The alert message may be visual and/or audible. If the computing device 400 does connect to the environmental control unit 290 then parameters 410 of the environmental control unit 290 will display on the computing device 400 through the graphic user interface 460 and block 614.

At block 616, the user may make a selection through the graphic user interface 460 whether to adjust the operations of the environmental control unit 290 or display the parameters 410 of the environmental control unit 290 on a map. If at block 616, the user selects to adjust the operations, then at block 618 the user may adjust the operations of the environmental control system 460 including but not limited to, temperature and humidity within the transport container 200. The controller 330 is configured to adjust operation of the fan 340 and the thermoelectric device 360 in response to a control command from a computing device 400 to adjust temperature and humidity. If at block 616, the user selects to view a map of the parameters 410, then at block 620 the graphic user interface 460 with display a map of the parameters 410 of the environmental control unit 290 on the computing device 400.

While the above description has described the flow process of FIG. 6 in a particular order, it should be appreciated that unless otherwise specifically required in the attached claims that the ordering of the steps may be varied.

As described above, embodiments can be in the form of processor-implemented processes and devices for practicing those processes, such as a processor. Embodiments can also be in the form of computer program code containing instructions embodied in tangible media, such as network cloud storage, SD cards, flash drives, floppy diskettes, CD ROMs, hard drives, or any other computer-readable storage medium, wherein, when the computer program code is loaded into and executed by a computer, the computer becomes a device for practicing the embodiments. Embodiments can also be in the form of computer program code, for example, whether stored in a storage medium, loaded into and/or executed by a computer, or transmitted over some transmission medium, loaded into and/or executed by a computer, or transmitted over some transmission medium, such as over electrical wiring or cabling, through fiber optics, or via electromagnetic radiation, wherein, when the computer program code is loaded into an executed by a computer, the computer becomes a device for practicing the embodiments. When implemented on a general-purpose microprocessor, the computer program code segments configure the microprocessor to create specific logic circuits.

The term "about" is intended to include the degree of error associated with measurement of the particular quantity based upon the equipment available at the time of filing the application. For example, "about" can include a range of ±8% or 5%, or 2% of a given value.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

While the present disclosure has been described with reference to an exemplary embodiment or embodiments, it will be understood by those skilled in the art that various changes may be made and equivalents may be substituted for elements thereof without departing from the scope of the present disclosure. In addition, many modifications may be made to adapt a particular situation or material to the teachings of the present disclosure without departing from the essential scope thereof. Therefore, it is intended that the present disclosure not be limited to the particular embodiment disclosed as the best mode contemplated for carrying out this present disclosure, but that the present disclosure will include all embodiments falling within the scope of the claims.

What is claimed is:

1. An environmental control unit for use with a transport container, the environmental control unit comprising:

a thermoelectric device;

a fan configured to blow air across the thermoelectric device;

a cooling module configured to receive the air blown across the thermoelectric device and convey the air to a compartment of a transport container when the transport container is removably connected to the environmental control unit;

a controller in electronic communication with the thermoelectric device and the fan; and a communication module in electronic communication with the controller, wherein the communication module is configured to transmit parameters of the environmental control unit to a computing device through wireless communication;

wherein the controller is configured to:

determine a present location of the transport container;

determine a destination of the transport container;

evaluate an internal temperature of the transport container;

determine, based on one or more of the destination, the present location, and the internal temperature, whether a condition inside of the transport container is sufficient to maintain an ideal temperature within the compartment with the cooling module switched off for at least some time during a remaining portion of travel to the destination; and control an on or off condition of the thermoelectric device based on the present location, the destination, and the internal temperature of the transport container.

2. The environmental control unit of claim 1, further comprising:

a battery configured to power the environmental control unit.

3. The environmental control unit of claim 1, further comprising:

a power source configured to power the environmental control unit, wherein the power source is a flywheel generator.

4. The environmental control unit of claim 1, further comprising:

a power source configured to power the environmental control unit, wherein the power source is a vehicle battery.

5. The environmental control unit of claim 1, wherein:

the communication module is configured to receive control commands from the computing device; and the controller is configured to adjust operation of the fan and the thermoelectric device in response to the control command.

6. The environmental control unit of claim 1, further comprising:

one or more sensors, configured to detect at least one of a temperature of air flowing through the cooling module, humidity of air flowing through the cooling module, and a location of the environmental control unit.

7. The environmental control unit of claim 1, wherein:

the transport container includes more than one compartment; and the environmental control unit includes at least one thermoelectric device for each compartment.

8. The environmental control unit of claim 1, further comprising:

a control panel located on an exterior of the environmental control unit, wherein the control panel is configured to receive input of at least one of a selected temperature for the environmental control unit, a maximum temperature for the environmental control unit, and a minimum temperature for the environmental control unit.

9. A refrigerated transport system comprising:

a transport container;

an environmental control unit removably connected to the transport container, the environmental control unit comprising:

a thermoelectric device;

a fan configured to blow air across the thermoelectric device;

a cooling module configured to receive the air blown across the thermoelectric device and convey the air to a compartment of the transport container;

a controller in electronic communication with the thermoelectric device and the fan; and a communication module in electronic communication with the controller and wireless communication with a computing device, wherein the communication module is configured to transmit parameters of the environmental control unit to the computing device through wireless communication; wherein the controller is configured to:

determine a present location of the transport container;

determine a destination of the transport container;

evaluate an internal temperature of the transport container;

determine, based on one or more of the destination, the present location, and the internal temperature, whether a condition inside of the transport container is sufficient to maintain an ideal temperature within the compartment with the cooling module switched off for at least some time during a remaining portion of travel to the destination; and control an on or off condition of the thermoelectric device based on the present location, the destination, and the internal temperature of the transport container.

10. The refrigerated transport system of claim 9, further comprising:

a battery configured to power the environmental control unit.

11. The refrigerated transport system of claim 9, further comprising:

a power source configured to power the environmental control unit, wherein the power source is a flywheel generator.

12. The refrigerated transport system of claim 9, further comprising:

a power source configured to power the environmental control unit, wherein the power source is a vehicle battery.

13. The refrigerated transport system of claim 9, wherein:

the communication module is configured to receive control commands from the computing device; and the controller is configured to adjust operation of the fan and the thermoelectric device in response to the control command.

14. The refrigerated transport system of claim 9, further comprising:

one or more sensors, configured to detect at least one of a temperature of air flowing through the cooling module, humidity of air flowing through the cooling module, and a location of the environmental control unit.

15. The refrigerated transport system of claim 9, wherein:

the transport container includes more than one compartment; and the environmental control unit includes at least one thermoelectric device for each compartment.

16. The refrigerated transport system of claim 9, further comprising:

a control panel located on an exterior of the environmental control unit, wherein the control panel is configured to receive input of at least one of a selected temperature for the environmental control unit, a maximum temperature for the environmental control unit, and a minimum temperature for the environmental control unit.

17. The refrigerated transport system of claim 9, wherein:

the computing device is configured to display parameters on a map though a graphical user interface.

18. A method of managing environmental conditions within a refrigerated transport system through a computing device, the method comprising:

determining, via a processor in the computing device, a present location of the refrigerated transport system;

determining, via the processor, a destination of the refrigerated transport system;

evaluating, via the processor, an internal temperature of the refrigerated transport system;

determining, based on one or more of the destination, the present location, and the internal temperature, whether a condition inside of the transport container is sufficient to maintain an ideal temperature for an item being cooled by the refrigerated transport system with the cooling modules switched off for at least a portion of time during travel to the destination; and controlling, via the processor, an on or off condition of a thermoelectric device based on the present location, the destination, and the internal temperature of the refrigerated transport system.

19. The method of claim 18, further comprising:

adjusting operation of an environmental control system using the computing device.

20. The method of claim 18, further comprising:

updating a route based on the adjusted operation of the environmental control system;

generating map through a graphic user interface on the computing device; and displaying an updated route on the map.

* * * * *